US005253794A

United States Patent [19]

Siemers et al.

[11] Patent Number: 5,253,794

[45] Date of Patent: Oct. 19, 1993

[54] REINFORCED MULTILAYER FILAMENT REINFORCED RING STRUCTURE

[75] Inventors: Paul A. Siemers, Clifton Park; Stephen F. Rutkowski, Duanesburg, both of N.Y.; Joseph J. Jackson, Topsfield; Donald R. Spriggs, San Diego, both of Calif.

[73] Assignee: General Electric Company, Schenectady, N.Y.

[21] Appl. No.: 973,512

[22] Filed: Nov. 9, 1992

Related U.S. Application Data

[62] Division of Ser. No. 546,961, Jul. 2, 1990.

[51] Int. Cl.[5] ..... B23K 31/02

[52] U.S. Cl. ..... 228/121; 228/190

[58] Field of Search ..... 228/121, 190, 265, 234, 228/237, 243; 29/419.1

[56] References Cited

U.S. PATENT DOCUMENTS 3,991,928 11/1976 Friedrich et al. ..... 228/190
4,697,324 10/1987 Grant et al. ..... 228/190
4,782,992 11/1988 Doble ..... 228/190
4,795,078 1/1989 Kuroki et al. ..... 228/175
4,896,815 1/1990 Rosenthal et al. ..... 228/234
4,919,594 4/1990 Wright et al. ..... 416/230
5,074,923 12/1991 Siemers et al. ..... 228/190

*Primary Examiner*—Mark Rosenbaum
*Assistant Examiner*—Chuck Y. Mah
*Attorney, Agent, or Firm*—James Magee, Jr.

[57] ABSTRACT

A method for forming a ring structure having a high volume fraction of a filament reinforcement within a metal matrix is disclosed. The ring structure is formed by consolidating a set of nested rings each of which has a high volume fraction of the filamentary reinforcement therein. The nesting is done to provide a clearance between the rings of the nest of about 2 or 3 mils. The nested rings are enclosed within a HIPing can and the structure is HIPed at about 15 ksi and 1000° C. for over an hour. A single superring structure results from the HIPing.

5 Claims, 3 Drawing Sheets

REINFORCED MULTILAYER FILAMENT REINFORCED RING STRUCTURE

This application is a division of application Ser. No. 07/546,961, filed Jul. 2, 1990.

The present invention relates closely to copending application Ser. No. 07/546,969, filed Dec. 3, 1992; and U.S. Pat. No. 5,074,923, and are incorporated herein by reference.

BACKGROUND OF THE INVENTION

The present invention relates to the formation of large ring structures. More particularly, it relates to the formation of filament reinforced ring structures having relative large diameters and having a relatively large number of layers of filament reinforcement of the order of 100 to 200 layers or more.

Methods for the formation of filament reinforced structures are disclosed in U.S. patents assigned to the same assignee as the subject application. The preparation of titanium alloy base foils, sheets, and similar articles and of reinforced structures in which silicon carbide fibers are embedded in a titanium base alloy are described in U.S. Pat. Nos. 4,775,547; 4,782,884; 4,786,566; 4,805,294; 4,805,833; and 4,838,337; assigned to the same assignee as the subject application. The texts of these patents are incorporated herein by reference.

Preparation of composites as described in these patents is the subject of intense study inasmuch as the composites have very high strength properties in relation to their weight. One of the properties which is particularly desirable is the high tensile properties imparted to the structures by the high tensile properties of the silicon carbide fibers or filaments. The tensile properties of the structures are related to the rule of mixtures. According to this rule the proportion of the property, such as the tensile property, which is attributed to the filament, as contrasted with the matrix, is determined by the volume percent of the filament present in the structure and by the tensile strength of the filament itself. Similarly, the proportion of the same tensile property which is attributed to the matrix is determined by the volume percent of the matrix present in the structure and the tensile strength of the matrix itself. To achieve high tensile properties in composite structures it is preferred to have a relatively high volume fraction of the filament reinforcement.

Prior to the development of the processes described in the above-referenced patents, such structures were prepared by sandwiching the reinforcing filaments between foils of titanium base alloy and by pressing the stacks of alternate layers of alloy and reinforcing filament until a composite structure was formed. However, that prior art practice was found to be less than satisfactory when attempts were made to form ring structures in which the filament was an internal reinforcement for the entire ring.

The structures taught in the above-referenced patents and the methods by which they are formed greatly improved over the earlier practice of forming sandwiches of matrix and reinforcing filament by compression.

Later it was found that while the structures prepared as described in the above-referenced patents have properties which are a great improvement over earlier structures, the attainment of the potentially very high ultimate tensile strength of these structures did not measure up to the values theoretically possible. The testing of composites formed according to the methods taught in the above patents has demonstrated that although modulus values are generally in good agreement with the rule of mixtures predictions, the ultimate tensile strength is usually much lower than predicted by the underlying properties of the individual ingredients to the composite. A number of applications have been filed which are directed toward overcoming the problem of lower than expected tensile properties and a number of these applications are copending. These include applications Ser. No. 445,203, filed Dec. 4, 1989; Ser. No. 459,894, filed Jan. 2, 1990; and Ser. Nos. 455,041 and 455,048, both filed Dec. 22, 1989. The texts of these applications are incorporated herein by reference.

One of the structures which has been found to be particularly desirable in the use of the technology of these reference patents is an annular article having a metal matrix and having silicon carbide filament reinforcement extending many times around the entire ring. Such ring structures have very high tensile properties relative to their weight particularly when compared to structures made entirely of metal. Such structures must be precise in their internal dimensions in order for the structures to be used most effectively in end use applications inasmuch as the structures are often used as part of a more complex structure and for this purpose are fitted over one or a number of elements in a circular form in order to serve as a reinforcing ring.

One of the structures which is formed has the reinforcing filament wound many times and in many layers around the circumference and is a reinforced ring structure. The reinforced ring can be used for example as a reinforcing ring for the compressor blades of a compressor disk of a jet engine. In order to serve to hold the blades in a compressor stage of a jet engine a large number of layers of reinforcing filaments are required.

The ring structures of concern here are structures which may be a few inches to a few feet in diameter The above referenced prior art patents and pending applications deal primarily with the technology and parameters of forming individual filament reinforced layers and with economical and reliable methods for forming structures having a relatively small number of such layers. However, there is no teaching in the referenced patents and applications about methods for forming ring structures having layers of filament reinforcement in excess of about 100 such layers.

It has been recognized that there is a limitation on the number of layers which can be added to a ring structure before a danger arises that the addition of further layers of filament reinforcement will cause buckling and damage to the filaments of the underlayers. The limit on the number of such layers before the potential for filament buckling and damage occurs is about 20 or 30 layers of filament reinforcement. While such structures are very valuable and are a vast improvement over structures which have been known heretofore, nevertheless there is a need for filament reinforced ring structures having a much larger number of layers of filaments to provide additional reinforcement.

It will be recognized that in forming rings by addition of a single layer of reinforcement at a time, the product ring can be inspected after each layer of reinforcement is added. Rings with a few layers of reinforcement can be discarded if found to be defective when inspected without substantial economic loss. However a single ring to which 60 layers have been added individually does represent a serious economic loss. This is another reason for forming ring segments of 20 layers each and condensing these into a single structure of 100 or 200 layers or more.

BRIEF STATEMENT OF THE INVENTION

Accordingly it is one object of the present invention to provide a method by which ring structures having a large number of filament reinforcement layers in excess of 100 such layers can be conveniently and economically formed.

Another object is to provide a method by which super strong ring structures based on filament reinforcement can be formed in large diameters and with a high ratio of filament reinforcement.

Other objects will be in part apparent and in part pointed out the description which follows.

In one of its broader aspects, objects of the invention can be achieved by forming a plurality of ring structures made up of filament reinforcement layers within a metal matrix. The formed rings are nested together to have a spacing therebetween of the order of a few to ten thousandths of an inch. The assembly of nested rings is then sealed within a HIPing can and the entire structure is HIPed at high temperature and high pressure. The HIPing can is then removed from the surface of the nested assembly of HIPed rings and it is observed that the ring structures have been unified into a single ring structure having a multiplicity of filament reinforcement layers of the order of 100 or more.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Figure 1:
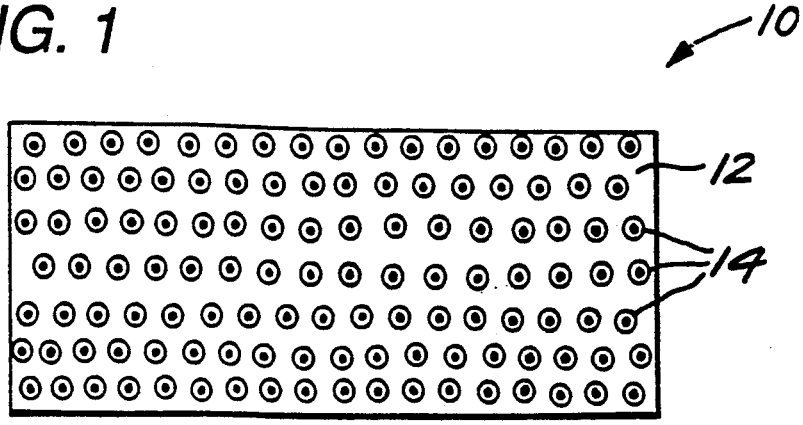
FIG. 1 is a cross sectional view of a ring structure displaying a plurality of layers of filament reinforcement within a matrix metal envelope.

One factor which must be kept in mind in carrying out the present method is the ratio of filaments to matrix in the composite structure. As indicated above, the rule of mixtures may be employed in determining the strength of the composite article based on the proportion of the article which is filament and the complementary proportion of the article which is matrix.

For articles to have their highest strength, the proportion of filament should also be high. A number of steps can be taken in carrying out the method of the present invention to ensure that the proportion of filament in the composite structure is at a desirably high value. Where the composite structure is to be formed by assembly and consolidation of a plurality of ring structures in the sense of a nested set of rings, steps are taken to limit or even minimize the amount of matrix material which is incorporated into the composite.

In this regard in practicing the present invention, a set of rings may be formed essentially as follows.

A mandrel is chosen to have a certain size in relation to the set of rings to be nested and consolidated into the 100 layer ring. As indicated above, the individual component rings of the set are formed with about 20 layers of filament. Where five component rings of a set are to be nested and consolidated into a single 100 layer ring, a certain amount of machining of the matrix material from both the inner and outer surfaces of the component rings is necessary in order to arrive at a set of component rings having a relatively high ratio of filament to matrix.

Accordingly a mandrel is selected to permit a layer of matrix metal to be formed on the surface thereof and to permit a subsequent removal of at least a portion of this matrix metal by a later machining operation. Thus if a mandrel having an external diameter of 12 inches is selected, a layer of matrix metal is first deposited on the mandrel. After the first layer of matrix metal has been deposited, the mandrel is removed as by machining or dissolution from the inside of the composite structure. The surface of the deposited matrix metal is generally relatively uneven and in addition is also relatively porous. In order to reduce this porosity, a grinding or machining operation can be performed on the deposited layer of matrix metal. The machining can involve a removal of the outer portion of the deposited layer of metal to provide a relatively smooth surface and can also involve a machining of a spiral groove into the surface to receive and to locate the reinforcing filament to be wound thereon. Such machining may remove, for example, about 15 mils of a 25 mil thick deposit of matrix metal. Following the machining and grooving, a layer of reinforcing filament is wound onto the matrix coated portion of the mandrel at a density of over 100 strands per inch. Such reinforcing filament may be aluminum oxide filament or silicon carbide filament or some other reinforcing filament. A preferred reinforcing filament is SCS-6 silicon carbide reinforcement available from the Textron Company.

The filament is wound as a layer onto the outer surface of the deposited matrix material. With the filament wound and anchored securely in place, a second layer of matrix material is plasma spray deposited over and around the strands of filament wound essentially in the form of a helix on the surface of the drum bearing the inner layer of matrix material and the layer of filament reinforcement. The deposit of the second layer of matrix material essentially embeds the layer of filament reinforcement within the matrix and presents a new uneven and relatively porous matrix at the outer surface of the drum. Following the deposit of the second layer of matrix material, the surface of the second layer is ground or machined to remove the irregular and relatively porous outer most portion of the matrix which has been deposited. After the surface layer is removed, a helical groove is machined in the matrix to receive the filament reinforcement. Of course in no event is the filamentary material exposed by the grinding or machining and grooving nor is any of it removed.

One reason for the removal of the more porous outer layer of the plasma spray deposit of matrix material is to increase the density of the final product of the alternating application of filament and matrix material. Another reason for removing the less dense outer portion of the matrix deposit is to enhance the uniformity of the spacing of the strands of the filamentary reinforcing layer which is wound onto the outer surface of the deposited matrix layer.

The process of wrapping a deposited matrix layer with a layer of filamentary reinforcement followed by spray deposit of matrix metal and the mechanical removal of a portion of the deposited matrix is repeated over and over to build up the structure on the mandrel, layer after layer, until a large number of layers of the order of 20 or 30 have been deposited on the mandrel. One object of the building of the composite ring structure in this fashion is to obtain a relatively high filament-to-matrix ratio and accordingly to achieve high tensile strength in the ring structure consistent with the rule of mixtures. After the mandrel has been removed, the inside layer of matrix metal which was first deposited on the mandrel is also removed by machining to further improve the filament-to-matrix ratio. Similarly, the uneven porous layer of the last deposit of matrix material is removed by machining.

The ring structure thus constituted is one of a series of rings to be nested concentrically with a number of other similar rings to form a large ring having a large number of layers of filamentary reinforcement of the order of 100 or more by a HIPing consolidation step.

Where the individual rings contain approximately 20 layers of filament reinforcement, an assembly of 5 or more such rings is made to form a large ring having more than 100 layers of filamentary reinforcement. In order to be consolidated by a HIPing operation, the outside diameter of one ring must be within 2 or 3 mils of the inside diameter of the next outer ring.

The process of forming the consolidated ring may be described with reference to the figures.

Referring first to FIG. 1, the figure is a semischematic illustration of the cross section 10 of one half of a ring. The matrix metal 12 embeds a series of layers 14 of filamentary reinforcement. The spacing of the layers of filament and the cross sectional representation of the individual filament strands and of the spacing between strands in a row is disproportionate to the actual product in order to preserve clarity of illustration. For example, in a ring having a width of about ¾ of an inch, the number of strands of filament in any one row would be about 85. Further in a cross section of such an article, the number of rows in a structure having a thickness of about ½ inch would be about 500. It is important to note that the volume fraction of filament as shown in the semischematic illustration of FIG. 1 may be more or less than the volume fraction of filament in an actual product.

Figure 2:
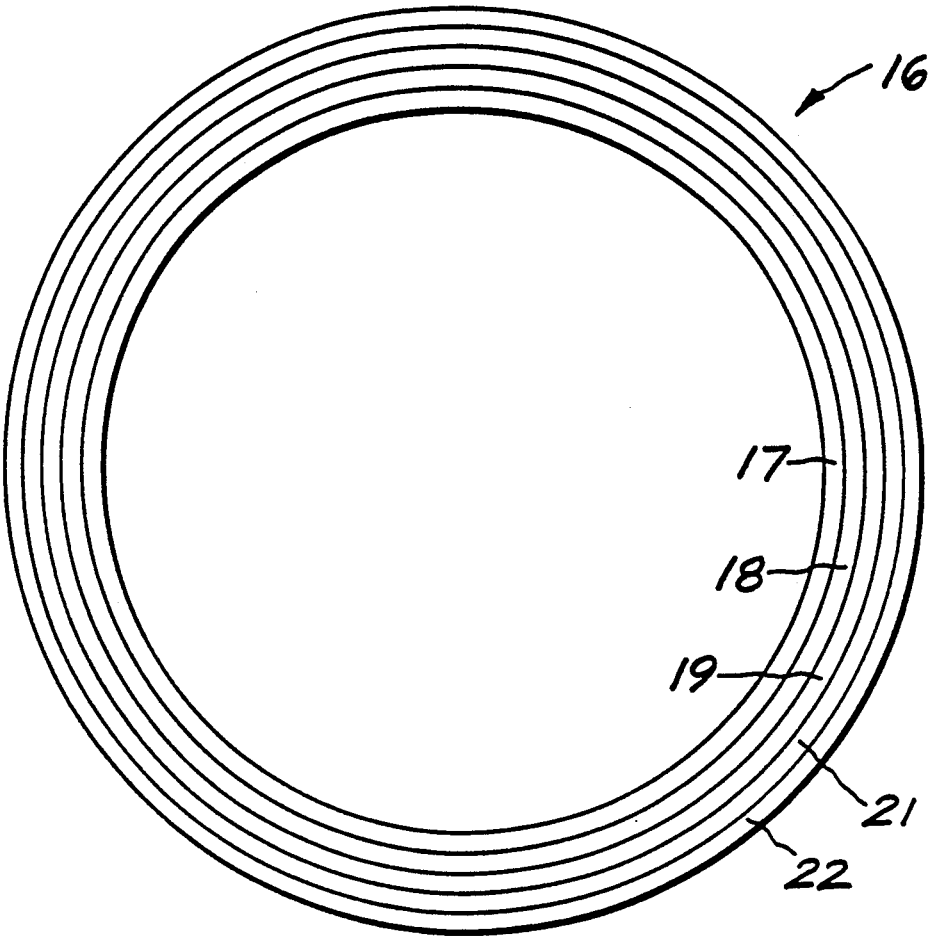
FIG. 2 is a cross sectional view of an assembly of a plurality of nested rings, each ring having a plurality of filament reinforcement layers of the order of 20 or 30 such layers.

Referring next to FIG. 2, a set 16 of rings 17, 18, 19, 21 and 22 is shown in nested formation illustrating the arrangement of rings concentrically placed within each other in preparation for a HIPing consolidation of a number of such rings.

Figure 3:
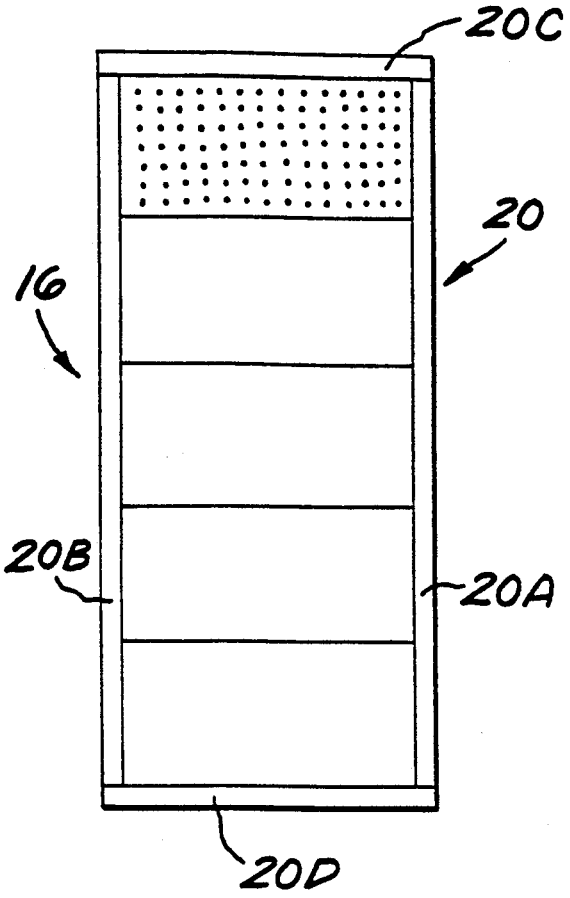
FIG. 3 is a cross sectional view of the structure of FIG. 2 enclosed within a HIPing can.

Referring next to FIG. 3, a semischematic cross sectional view through one half of the set 16 of rings of RD-20.406 FIG. 2 is illustrated mounted within a HIPing can 20. Such a can may be formed of mild steel and is usually made by assembling flange-like elements 20*a* and 20*b* and collar like elements 20*c* and 20*d* to form the can which can be welded along its seams to hermetically seal the seams and to seal the contents of the can from the exterior of the can. The rings may be isolated from the steel HIP can by a thin foil of molybdenum. A port for evacuation of gas from the can, not shown, is provided in a conventional manner. The can contains 5 concentric rings, the outermost, 22, of which shows a set of filaments similar to the filaments illustrated in FIG. 1. Each of the other rings contains similar set of filaments but are not shown in the Figure for convenience and clarity of illustration. The material of the can, elements 20*a*, 20*b*, 20*c* and 20*d*, may be, for example, a mild steel.

The structure as semischematically illustrated in FIG. 3 is next HIPed by application of temperature of about 1000° C. and a pressure of about 15 ksi for an hour or more depending on the approximate need for effecting consolidation of the member rings of the set enclosed within the can 20.

Figure 4:
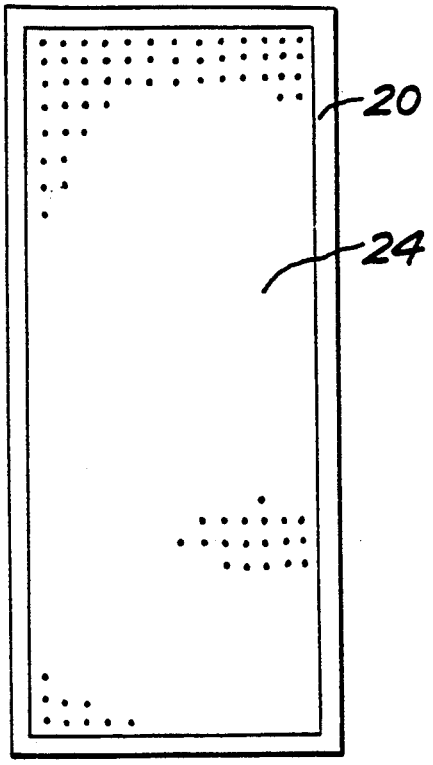
FIG. 4 is a cross sectional view of the unified ring structure following the HIPing and consolidation of the plurality of nested rings into the single unified ring structure.

Referring next FIG. 4, the structure illustrated in FIG. 3 is converted to a single unified ring structure, which might be termed a superring, by the consolidation of the five individual rings housed within the HIPing can 20. As is evident from FIG. 4, the seams which separated the individual rings, as illustrated in FIG. 3, are eliminated during the HIPing as the rings consolidate into a single superring structure, as illustrated in FIG. 4 within the HIPing can 20. Again the uppermost portion, mid portion and lowermost portion of the superring 24 is marked to show in semischematic fashion the presence of the rows of filaments but the remaining portion is left blank for convenience of illustration.

Figure 5:
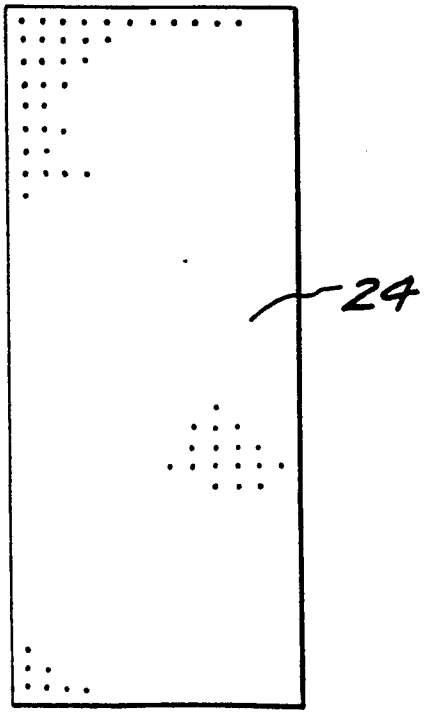
FIG. 5 is a semischematic illustration of the structure of FIG. 4 following removal of the HIPing can.

Referring next to FIG. 5, the superring structure 24 which is formed as described above is illustrated as it exists after the HIPing can has been removed by mechanical means, such as machining.

The volume fraction of filamentary reinforcement is desirably at least 20 volume percent and is less than 70 volume percent. For some applications a volume fraction between about 30 and 50 volume percent is preferred. The preferred volume fraction will vary with the specific application to be made of the superring structures.

The effectiveness of the method may be illustrated by the following Example.

EXAMPLE 1

Two, nominally four inch diameter, four inch wide, four ply composite rings were fabricated using a Ti-14Al-21Nb matrix alloy and SCS-6 SiC filament. The rings were fabricated by initially spraying about ⅛ inch of Ti-1421 matrix alloy onto a steel mandrel that had been coated with 0.005 inches of $Al_2O_3$. After cooling, the ⅛ inch thick Ti-1421 ring was debonded from the steel mandrel at the steel-$Al_2O_3$ interface. The initial diameters of the two rings were selected such that the final diameters of the Ti-1421 rings plus the anticipated composite thickness would allow the two rings to be "nested" after composite fabrication.

Four ply composite rings were fabricated using the ⅛ inch thick Ti-1421 rings as mandrels. The composite rings were fabricated by alternately machining the "as-sprayed" surface smooth, machining a helical groove about 0.003" deep with a spacing of 112 grooves per inch, winding continuous SCS-6 SiC filament in the groove, and overspraying the wound ring with additional Ti-1421 material. The above process was repeated until four plies were obtained on each ring. If the rings became "out-of-round" because of the repeated thermal cycles the partially completed rings were restored to roundness by thermally sizing them on a solid 304L stainless steel mandrel at 900° C. for 15 minutes at temperature.

After plasma spray fabrication of the rings was completed, each of the two four ply rings were cut into three smaller rings. The OD's of two of the smaller diameter rings were machined to within 0.005" of the ID's of two of the larger rings. After machining the rings could be "nested" to form closely fitting ring pairs.

The two pairs of nested rings were sealed in HIP cans which had been machined from mold steel. The HIP can design comprised an inner ring, an outer ring, and two end rings which closely matched the dimensions of the nesting rings. Provisions were made to evaluate the HIP can prior to sealing. In one HIP can the wall thickness of the inner ring was the same as the wall thickness of the outer ring (0.083"). for the second HIP can the wall thickness of the outer ring (0.250") was three times as thick as the wall thickness of the inner ring (0.083"). The intent of the asymmetrical can design was to force the inside diameter of the nesting rings to move outwards rather than have the outside diameter move inwards during the HIP densification.

The two HIP cans were HIPed for 3 hours at 1000° C. and 15 ksi pressure. After HIPing the cans were removed by chemical dissolution in an acid solution. Table 1 shows the inside and outside diameters of the nesting ring pairs before and after HIPing.

Figure 6A:
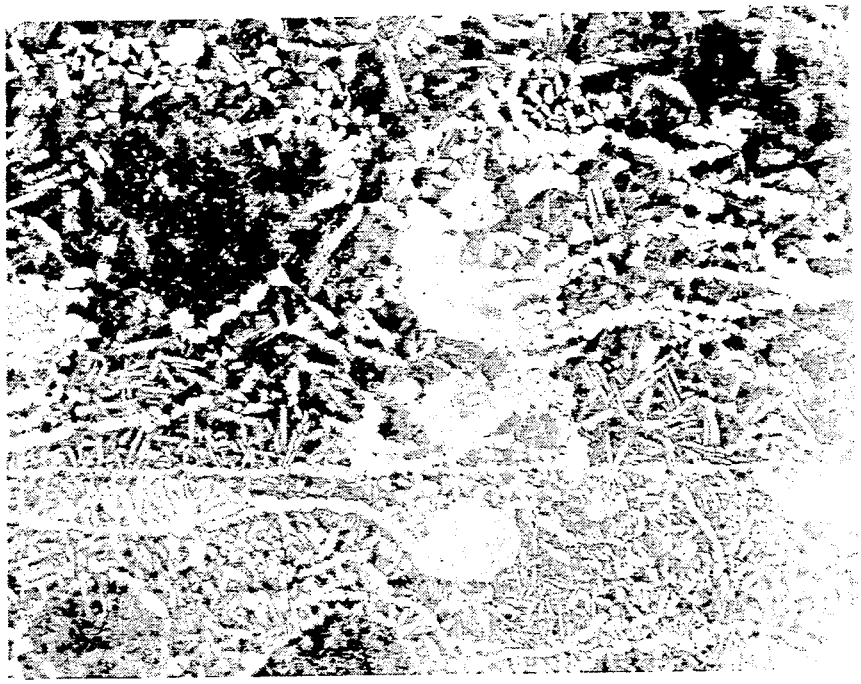
FIG. 6A and 6B are micrographs of the bond line formed between adjoining rings.
Figure 6B:
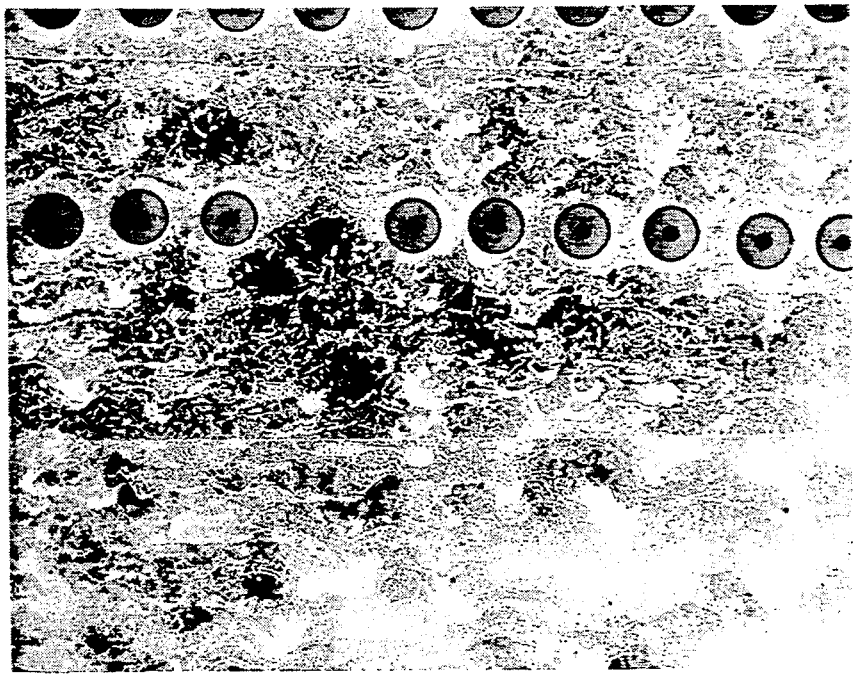

One of the rings was cut and a section was polished and examined metallographically. FIG. 6 shows the cross-section of the bond line at high 6A magnification and at low 6B magnification. FIGS. 6A and 6B show that the bond line was very "clean" and barely visible, suggesting a sound bond.

TABLE 1

Nested Ring Dimensional Changes During HIPing

| | ID Before (inches) | ID After (inches) | ID Difference (inches) | % Change |
|---|---|---|---|---|
| Symmetrical | 3.447 | 3.422 | −0.025 | −0.7 |
| Asymmetrical | 3.726 | 3.690 | −0.036 | −1.0 |
| | OD Before (inches) | OD After (inches) | OD Difference (inches) | % Change |
| Symmetrical | 3.775 | 3.757 | −0.018 | −0.5 |

TABLE 1-continued

Nested Ring Dimensional Changes During HIPing

| | | | | |
|---|---|---|---|---|
| Asymmetrical | 4.118 | 4.110 | −0.008 | −0.2 |

It is evident that the structure underwent dimensional changes as a result of the HIPing. These dimensional changes accompanied the consolidation of the two nested ring structures within each HIP can to a single consolidated structure.

The method of the present invention may be carried out to produce a superring structure having a high volume fraction of filamentary reinforcement embedded in a titanium base matrix metal by first providing a plurality of individual ring structures as a nestable set. Each of such ring structures has a continuous filamentary reinforcement embedded in the matrix metal. The set of rings is assembled to form a nested array and to maintain a clearance between adjacent rings of no more than 0.030 of an inch. This clearance may be less than 0.006 of an inch. The assembled set of nested rings is enclosed within a HIPing can and the enclosed rings are HIPped for at least 30 minutes at at least 5 ksi, and at a temperature of at least 800 degrees Centigrade.

What is claimed is:

1. The method of forming a superring structure having a high volume fraction of filamentary reinforcement embedded in a titanium base matrix metal which comprises providing a plurality of individual ring structures as a nestable set, each of said ring structures having continuous filamentary reinforcement of at least several layers embedded in the matrix metal, assembling said rings into a nested, concentric set and maintaining a clearance between the adjacent rings of said set of no more than 0.030 of an inch, enclosing the set of nested rings within a HIPing can, and HIPing the enclosed rings for at least 30 minutes at at least 5 ksi, and at least 800° C.

2. The method of claim 1 in which the matrix metal is Ti-6242.

3. The method of claim 1 in which the matrix metal is Ti-1421.

4. The method of claim 1 in which the filament reinforcement is silicon carbide filament.

5. The method of claim 1 in which the clearance maintained is less than 0.006 inches.

* * * * *